US005810614A

United States Patent [19]

Ruch

[11] Patent Number: 5,810,614

[45] Date of Patent: Sep. 22, 1998

[54] SYSTEM FOR SECURING AND ALIGNING MATING CONNECTORS

[75] Inventor: Mark H. Ruch, Spring, Tex.

[73] Assignee: Compaq Computer Corporation, Houston, Tex.

[21] Appl. No.: 937,492

[22] Filed: Aug. 28, 1992

[51] Int. Cl.[6] ..... H01B 13/629

[52] U.S. Cl. ..... 439/247; 439/557

[58] Field of Search ..... 439/246–248, 439/552, 555, 557

[56] References Cited

U.S. PATENT DOCUMENTS

| | | | |
|---|---|---|---|
| 4,602,351 | 7/1986 | Shimamura et al. | 439/248 |
| 4,915,641 | 4/1990 | Miskin et al. | 439/247 |
| 4,934,943 | 6/1990 | Klein et al. | 439/248 X |
| 4,998,889 | 3/1991 | Moly | 439/248 X |
| 5,078,615 | 1/1992 | Benson et al. | 439/246 |
| 5,199,896 | 4/1993 | Mosquera | 439/557 |

FOREIGN PATENT DOCUMENTS

| | | | |
|---|---|---|---|
| 0147828 | 7/1985 | European Pat. Off. | 439/557 |

*Primary Examiner*—P. Austin Bradley
*Assistant Examiner*—Jill Demello
*Attorney, Agent, or Firm*—Vinson & Elkins L.L.P.

[57] ABSTRACT

A system for aligning and securing a first connector to a second connector includes structure for holding the first connector and structure for receivedly engaging the second connector. The structure for holding the first connector is designed to be linearly moveable and the structure for receivedly engaging the second connector is fixedly positioned relatively to the structure for holding the first connector.

6 Claims, 4 Drawing Sheets

SYSTEM FOR SECURING AND ALIGNING MATING CONNECTORS

BACKGROUND OF THE INVENTION

1. Field of the Invention

The present invention relates to systems for aligning connectors. More particularly, the present invention relates to systems for aligning connectors mounted on two surfaces which are loosely mated.

2. Description of Related Art

Many machines require mechanical, electrical, or both mechanical and electrical connections to be made between components. There are countless examples of such machines. One example is modern office printers. To facilitate handling various different sizes and types of paper, modern office printers comprise a printing "engine" and a cassette or cassettes for holding paper. The cassettes mount into or otherwise connect to the engine, whereupon a paper handling mechanism may be engaged to extract paper from the cassette and to transport it into the engine to be printed upon.

Both mechanical and electrical connections may need to be made between the aforementioned engines and cassettes. Mechanically, the cassette must be held in place to allow the paper handing mechanism to function properly. Electrical connections are frequently employed to power paper manipulating elements within the cassette itself. For example, a cassette may be configured to hold two separate stacks of paper. During use of such a cassette, one of the stacks of paper (e.g., in the "front", or positioned relatively close to the engine) may be fed into the machine normally. Then, when the front stack of paper is completely used, paper manipulating elements within the cassette itself may be employed to move the second or "rear" stack of paper to the "front" to be fed to the engine.

As the cassette/engine art has developed, a characteristic of the products that has become expected is a "looseness" in fit between the cassette and engine when connection is made. Generally, engines have a slot through an outside wall leading an inner chamber into which the cassette is inserted for operation. Notable separation between the walls of the inner chamber and the outer bounds of a cassette has come to be expected by office machine users. Notwithstanding this fact, a suitable electromechanical connection must be made between the cassette and the engine. Thus, whether the cassette is inserted into the inner chamber of the engine generally up or down, or sideways, proper alignment and securement must somehow be effected by the time the cassette is fully inserted.

Based upon the foregoing, it may be envisioned that both printing engines and cassettes include connector elements that must be connected for operation. Heretofore, such connector elements are hard mounted in the engine and cassette, respectively, and rough alignment features are provided to drive the two hard mounted connectors together. A typical example of such a rough alignment feature is a cone-shaped protrusion on the engine that may engage a hole in the cassette housing. Such a protrusion and a hole can cooperate to drive or force not only the connector elements together, but also to drive or force the elements to which the connector elements are hard mounted together.

There are a number of shortcomings and deficiencies of the prior art "hard mounted" systems. First, such systems require considerable space to operate. The forcing function inherently takes more space to operate than would a more forgiving, pliable system. Secondly, such systems are relatively difficult to use. Forcing, rather than merely aligning, is less likely to smoothly make a connection, and it is more likely to create jams without a proper connection. Further, such systems have relatively short life spans. Forcing, rather than more purely aligning, inevitably shortens the life of pins and the like that ultimately make the needed electrical connections.

SUMMARY OF THE INVENTION

The present invention overcomes the shortcomings and deficiencies of the prior art by providing a system for aligning and securing a first connector to a second connector, which system includes structure for holding the first connector and which system also includes structure for receivedly engaging the second connector. According to the teachings of the present invention the structure for holding the first connector is designed to be linearly moveable and the structure for receivedly engaging the second connector is fixedly positioned relative to the structure for holding the first connector.

In specific embodiments of the present invention, the structure for holding the first connector may include a housing and at least one spring-biased arm projecting from the housing, which arm includes portions which may ride in a slot in a larger support structure, so that linear movement is allowed and imposed on the structure for holding.

Also in specific embodiments of the present invention, the structure for receivedly engaging the second connector may include at least one bayonet-shaped protrusion connected to the housing, which bayonet-shaped protrusion has a generally rounded distal portion.

Accordingly, an object of the present invention is to provide a means to align connectors on two surfaces which are loosely mated.

Another object of the present invention is to provide an apparatus or system which may be readily incorporated for use with existing connectors in office printers and the like.

Yet another object of the present invention is to provide a connector mating system that is small relative to prior art systems.

Still yet another object of the present invention is to provide a connector mating system that aligns connectors without necessarily forcing movement of larger structures such as is the case when connectors are hard mounted to larger structures.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE INVENTION

Figure 1:
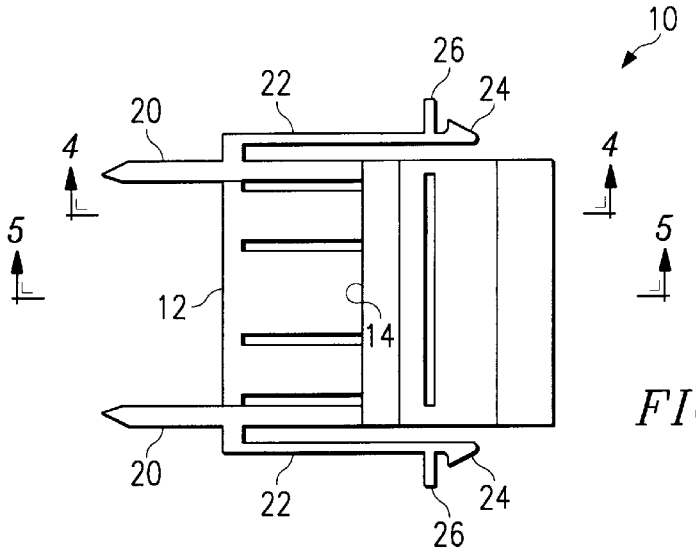
FIG. 1 is a top plan view of an apparatus according to the teachings of the present invention, which apparatus is used to secure and align mating connectors.

Referring now to the drawings wherein like or similar elements are designated with identical reference numerals throughout the several views, and wherein elements are not necessarily shown drawn to scale, and, more particularly, to FIG. 1, there is shown an apparatus according to the teachings of the present invention (generally designated by reference numeral 10), which apparatus 10 may be used to secure and align mating connectors.

The apparatus 10 depicted in FIG. 1 may be seen to comprise a base portion 12. This base portion 12, in conjunction with a ceiling portion 14 (more clearly shown in FIGS. 5 and 6) form a housing that can hold a first connector 16 (shown in FIG. 6).

Figure 4:
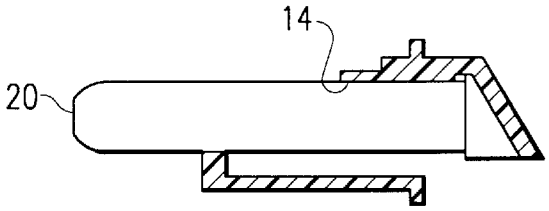
FIG. 4 is a cross-sectional view taken along line 4—4 in FIG. 1.
Figure 5:
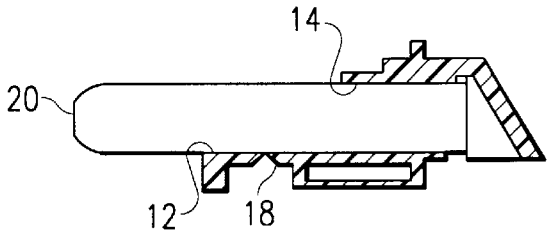
FIG. 5 is a cross-sectional view taken along line 5—5 in FIG. 1.
Figure 6A:
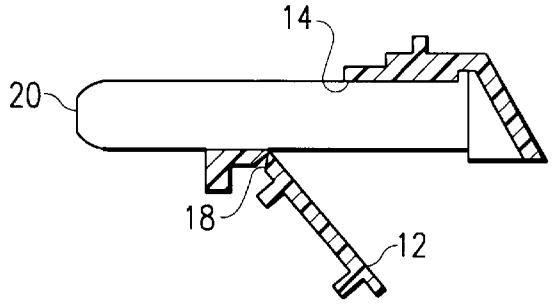
FIGS. 6A–E depict, in a successive manner, the insertion of a connector into the apparatus of FIG. 1.
Figure 6B:
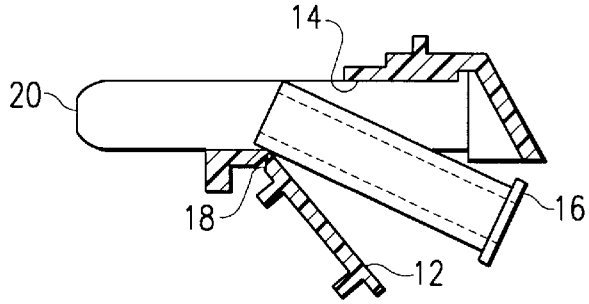
Figure 6C:
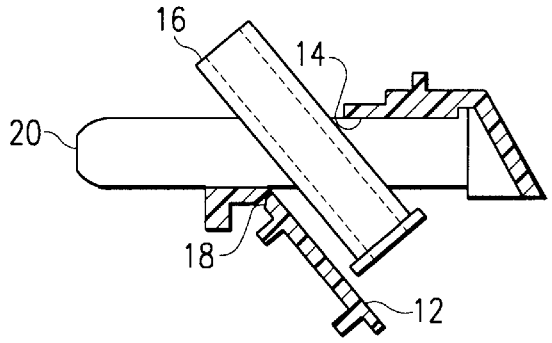
Figure 6D:
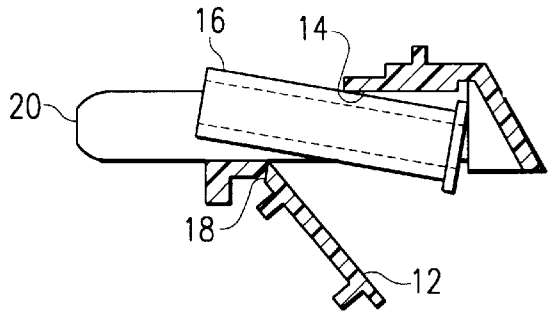
Figure 6E:
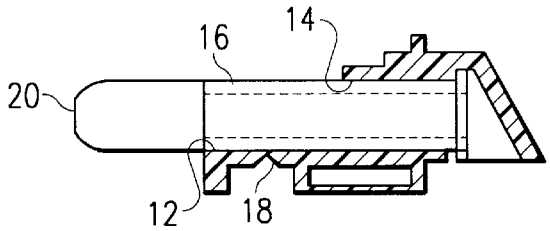

A complete understanding of the housing or "means for holding a first connector" may be obtained based upon FIGS. 1, 4, 5 and 6. FIGS. 4 and 5 collectively show that a portion of the base portion 12 forms a living hinge 18 that allows easy insertion of the first connector 16. FIG. 6 shows, in a successive manner, how the housing may be opened by rotating a portion of floor 12 at the hinge 18 (FIG. 6A), and how then a first connector 16 may be inserted and rotated up into the housing (FIGS. 6B–D) which may then be closed (FIG. 6E). Such installation of a connector 16 into the housing formed by floor 12 and ceiling 14 effectively fixes the connector 16 with respect to the apparatus 10, but, very importantly, as will be discussed in more detail below, does not necessarily fix the connector 16 to any other structure (e.g., the engine itself).

Referring again to FIG. 1, apparatus 10 may also be seen to include two bayonet-shaped structures 20. These bayonet-shaped structures are designed to receivedly engage a second connector (not shown) which would be inserted towards apparatus 10 from left to right in the orientation shown in FIG. 1. Generally, in embodiments of the present invention, these bayonet-shaped structures are formed of such material that they 20 are flexible, so as to be capable of performing a guiding function, discussed in greater detail below.

Figure 2A:
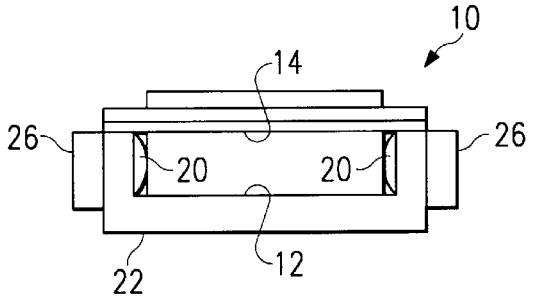
FIG. 2A, 2B and 2C are, respectively, left side, front, and right side views of the apparatus shown in FIG. 1.
Figure 2B:
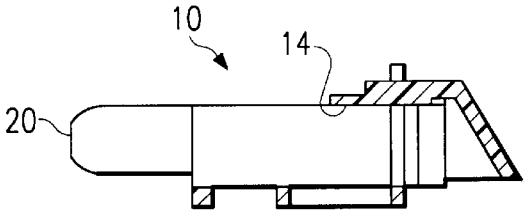

Referring now to FIG. 2B, it may be seen that the distal portion of a bayonet-shaped structure is generally rounded. That fact, coupled with the fact that each bayonet-shaped structure 20 also has a relatively sharply tapered distal portion (or "tip"), should be understood by those skilled in the art to facilitate their use as means for receivedly engaging and causing alignment of a second connector as it is pushed into apparatus 10 to be mated with the first connector 16.

Figure 7:
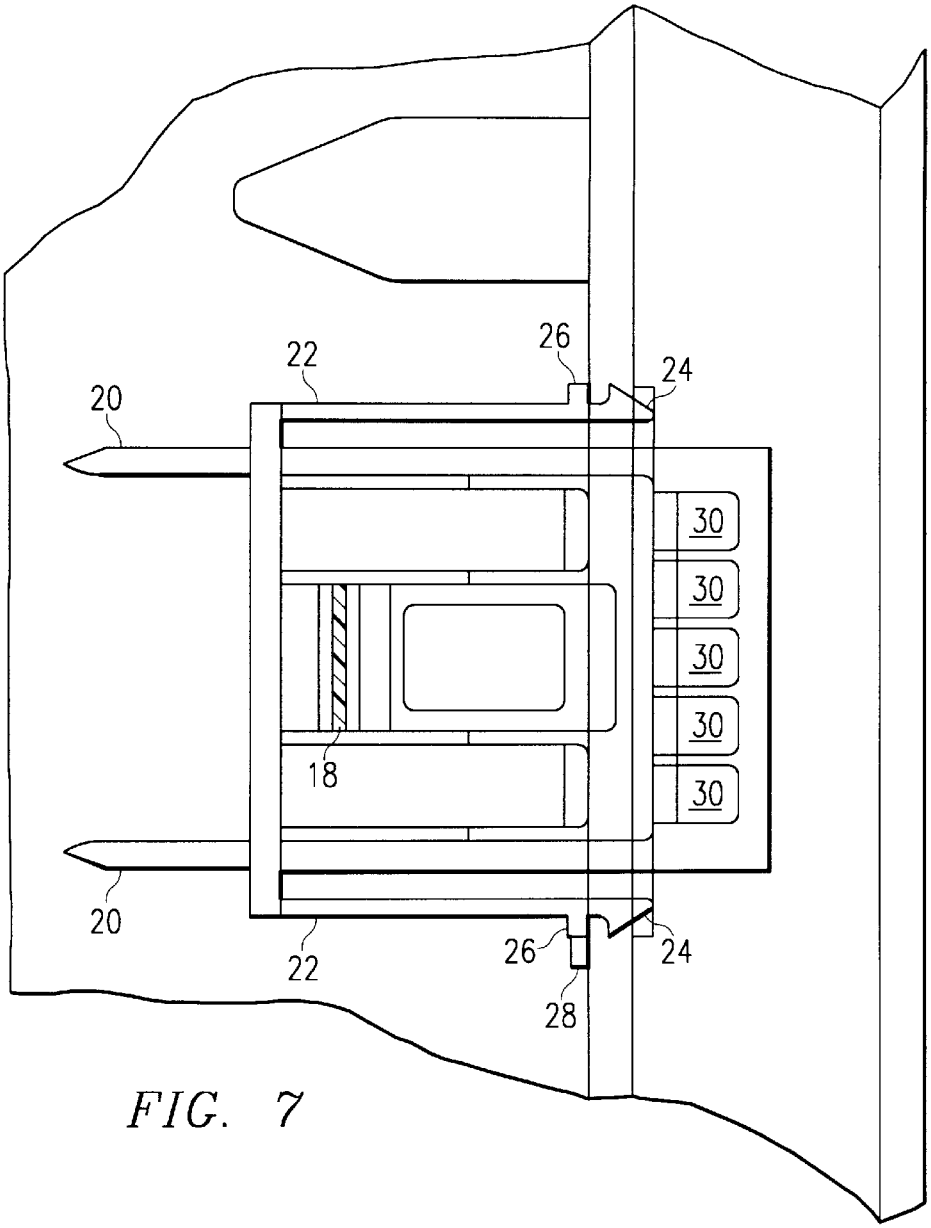
FIG. 7 depicts the apparatus of FIG. 1 installed in an engine where it may linearly move.
Figure 8:
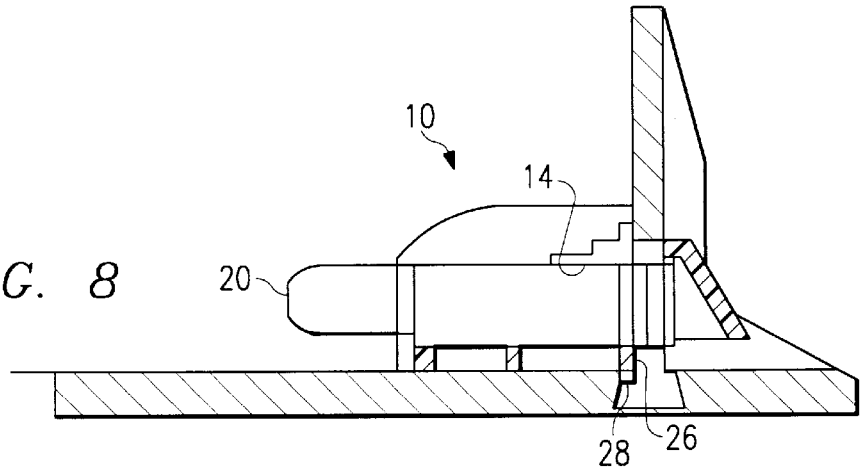
FIG. 8 is another view of the apparatus of FIG. 1 installed in an engine where it may linearly move.

Referring now to FIGS. 7 and 8, and recalling the discussion in the description of related art above, the apparatus 10 is there shown installed in the rear of a cassette-receiving slot of a printer engine. So positioned, when a cassette being inserted into the slot reaches the end of the slot, holes or other portions of the cassette structure can engage the bayonet-shaped structures 20 to ultimately result in alignment of a second connector carried on the cassette and the first connector carried in the housing of apparatus 10. As those skilled in the art should readily understand and appreciate, the insertion of a cassette as described above may exert force in some direction on apparatus 10. This force may be exerted either up or down or to one side or the other. Apparatus 10 has a unique mechanism for dealing with such force, which unique mechanism will be discussed in greater detail below.

Referring once again to FIG. 1, it may also be seen that apparatus 10 includes a spring-biased arm feature. This feature consists of arms 22 having portions defining hooks 24 at their distal ends. To the origin side of those distal ends, the arms 22 also have portions defining walls 26, which walls 26 may cooperate with slots in larger structure to allow and impose linear movement upon apparatus 10. Such imposition can be best understood with reference to FIGS. 7 and 8. In those two FIGs. it may be seen that the walls 26 may ride in slots 28 within the engine. Thus, when a force is exerted on apparatus 10, such as by a cassette impinging upon the bayonet-shaped structures 20, the apparatus 10 may move in a linear direction as allowed by the movement of the walls 26 against and through the slot 28. This allows the apparatus 10 to move to accommodate or to otherwise better align a second connector being inserted into, for example, a cassette receiving slot of a printing engine for mating to connector 16. The aforementioned hooks 24 provide an easily mounting and restraining feature, that facilitates mounting of the apparatus 10 to an engine or the like.

Figure 2C:
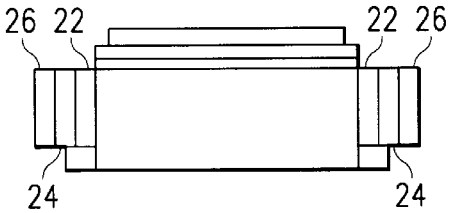
Figure 3:
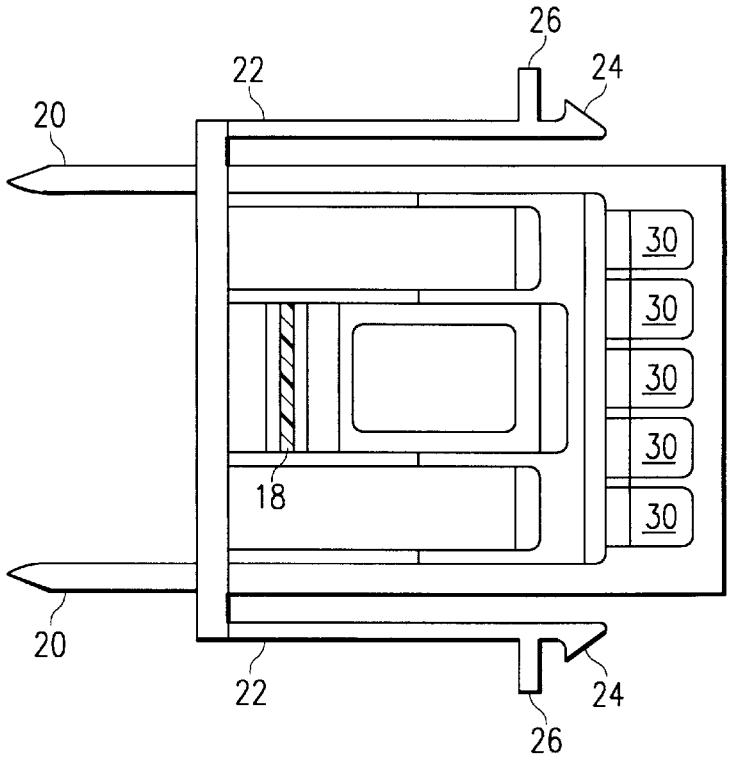
FIG. 3 is a bottom plan view of the apparatus shown in FIG. 1.

Recognizing that an embodiment of the present invention as shown in FIG. 1 has heretofore been constructed and used with great success, FIGS. 2A and 2C, which present different views of the apparatus of FIG. 1, are presented herein to give those skilled in the art a better understanding of what one particular embodiment of the present invention may look like. FIG. 3, a bottom plan view of the apparatus of FIG. 1, is also useful for this reason. FIG. 3 is also useful insofar as it shows that the apparatus 10 allows some five electrical contacts (via contacts 28) to be made.

Based upon the foregoing, those skilled in the art should appreciate that the present invention provides a unique apparatus and system for aligning and securing mating connectors. Embodiments of the present invention include bayonet-shaped structures with flexible walls. These bayonet-shaped structures enable, in a gross sense, determination in blind operation of where the mating, i.e., second, connector is located. Further, as the connectors approach each other to mate, the two bayonet-shaped structures act like springs to guide the various elements together. The bayonet-shaped structures do not force alignment, in the sense that hard mounted systems force alignment; rather, the bayonet-shaped structures urge and guide the connectors involved into mating alignment.

Also based upon the foregoing, those skilled in the art should appreciate that the present invention provides a unique apparatus for aligning and securing mating connectors, which apparatus may linearly move to accomplish mating. This linear movement, or "horizontal float", is allowed by spring arms having portions that may ride in an engine slot. Thus, an apparatus according to the teachings of the present invention, may be snapped into the back of a cassette receiving slot in an engine, and when the paper cassette is installed in that slot it will mate correctly with the engine regardless of whether the cassette enters generally to the left or right or up or down, in the slot.

Generally, mating cassettes, when inserted into an engine, are ultimately forced to a certain point vertically, but they have some left to right flexibility with the aforementioned "horizontal float" to effect matings.

The present invention thus provides a system for aligning and securing mating connectors that is relatively small, that allows use of existing connectors, and that emphasizes alignment rather than force in mating.

Obviously, numerous modifications and variations are possible in view of the above teachings. Accordingly, within the scope of the appended claims, the present invention may be practiced otherwise than as specifically described above.

What is claimed is:

1. A housing for a connector comprising:

an enclosure for holding the connector;

one or more flexible guides coupled to said enclosure for mating with a cooperating connector housing;

a plurality of spring arms coupled to said enclosure for mating with a rigid member, said spring arms operable to allow said enclosure to move laterally relative to said rigid member such that said enclosure may move to a proper location to mate with said cooperating connector housing responsive to said guides.

2. The housing of claim 1 wherein said guides have end portions.

3. A connector system for connecting first and second connectors comprising:

an enclosure for holding said first connector, said enclosure having an opening member for opening to receive said first connector into said enclosure and closing to retain said first connector in said enclosure;

first and second flexible guides protruding outwardly from said enclosure for cooperating with first and second receptacles associated with the second connector;

first and second spring arms for coupling said enclosure to a rigid member while allowing said enclosure to move laterally responsive to interaction between said guides and the second connector in order to allow connection between the first and second connectors without the need for precise alignment.

4. A housing for a connector comprising:

an enclosure for holding the connector, said enclosure having a means for opening to allow insertion of said connector;

one or more guides coupled to said enclosure for mating with a cooperating connector housing;

a plurality of spring arms coupled to said enclosure for mating with a rigid member, said spring arms operable to allow said enclosure to move laterally relative to said rigid member such that said enclosure may move to a proper location to mate with said cooperating connector housing responsive to said guides.

5. The housing of claim 4 wherein said opening means comprises a door member coupled to a flexible hinge for allowing said door member to rotate away from said enclosure to allow insertion of the connector into the enclosure.

6. A housing for a connector comprising:

an enclosure for holding the connector;

one or more guides coupled to said enclosure for mating with a cooperating connector housing;

a plurality of spring arms coupled to said enclosure for mating with a rigid member, said spring arms having wall portions for mating with a corresponding slot in said rigid member, said spring arms operable to allow said enclosure to move laterally relative to said rigid member such that said enclosure may move to a proper location to mate with said cooperating connector housing responsive to said guides.

* * * * *